US007500829B2

(12) United States Patent
Edwards et al.

(10) Patent No.: US 7,500,829 B2
(45) Date of Patent: Mar. 10, 2009

(54) TWO PIECE SEPARABLE IMPELLER AND INNER DRIVE FOR PUMP

(75) Inventors: Stanley W. Edwards, Arvada, CO (US); Loren G. McGilvrey, Highlands Ranch, CO (US); Sheldon Swenson, Arvada, CO (US)

(73) Assignee: Sundyne Corporation, Arvada, CO (US)

( * ) Notice: Subject to any disclaimer, the term of this patent is extended or adjusted under 35 U.S.C. 154(b) by 295 days.

(21) Appl. No.: 11/098,336

(22) Filed: Apr. 4, 2005

(65) Prior Publication Data

US 2006/0177321 A1 Aug. 10, 2006

Related U.S. Application Data

(60) Provisional application No. 60/650,645, filed on Feb. 4, 2005.

(51) Int. Cl.
*F04D 29/20* (2006.01)

(52) U.S. Cl. ..... 416/170 R; 416/204 R; 416/241 A; 417/420

(58) Field of Classification Search ..... 416/170 R, 416/204 R, 241 A; 417/420
See application file for complete search history.

(56) References Cited

U.S. PATENT DOCUMENTS

| | | | | |
|---|---|---|---|---|
| 4,013,384 A | | 3/1977 | Oikawa et al. | |
| 5,269,664 A | | 12/1993 | Buse et al. | |
| 5,380,112 A | | 1/1995 | Schicktanz et al. | |
| 5,779,449 A | | 7/1998 | Klein | |
| 5,779,456 A | * | 7/1998 | Bowes et al. | 417/420 |
| 5,895,203 A | | 4/1999 | Klein | |
| 5,915,931 A | * | 6/1999 | Lindner et al. | 417/420 |
| 6,007,312 A | * | 12/1999 | Pieters et al. | 417/420 |
| 6,443,710 B1 | | 9/2002 | Tatsukami et al. | |
| 2002/0054820 A1 | | 5/2002 | Fukamachi et al. | |

FOREIGN PATENT DOCUMENTS

| | | |
|---|---|---|
| DE | 4015519 A1 | 11/1991 |
| EP | 1340917 A | 9/2003 |
| EP | 1340917 A1 | 9/2003 |

OTHER PUBLICATIONS

Search Report PCT/US2006/004250.
International Preliminary Report on Patentability, Application No. PCT/US2006/004250, Aug. 16, 2007.
Durco PolyChem Process Pumps, Printed in U.S.A Oct. 1999 by Flowserve Corporation, pp. 1-28, Bulletin P-30-500a(E).

* cited by examiner

*Primary Examiner*—Ninh H Nguyen
(74) *Attorney, Agent, or Firm*—Carlson, Gaskey & Olds

(57) ABSTRACT

A separable impeller and inner drive are constructed from different plastics. The inner drive includes a metallic drive ring that receives drive lugs extending from the impeller. A bushing directly supports the inner drive and impeller and maintains extensions from the impeller in engagement with an annular groove in the inner drive.

20 Claims, 2 Drawing Sheets

TWO PIECE SEPARABLE IMPELLER AND INNER DRIVE FOR PUMP

This application claims priority to U.S. Provisional Patent Application No. 60/650,645, filed Feb. 4, 2005.

BACKGROUND OF THE INVENTION

This invention relates to a magnetically driven chemical pump having a two piece, separable impeller and inner drive.

Magnetic drive centrifugal pumps include a wet portion, which contains the process fluid that is being pumped, and a dry portion having a drive, which provides power to the pumped fluid. The dry portion is exposed only to the atmosphere surrounding the pump. In one typical magnetic drive design, an inner and outer drive are separated by a plastic containment shell, which prevents the pumped fluid from escaping to the environment. The outer drive, which is usually driven by an electric motor, is located in the dry portion and magnetically drives the inner drive in the wet portion that is attached to a pump impeller. Since magnetic drive pumps are seal-less, they are often selected to pump very acidic or caustic process fluids, such as hydrochloric acid, nitric acid, and sodium hypochlorite.

The inner drive, which includes magnets, and impeller are typically integrally formed with one another. A plastic coating surrounds the magnets preventing the magnets from corroding and the pump from failing. Typically, the impeller is constructed from a fiber reinforced plastic to provide strength, which dictates that the plastic encapsulating the magnets be formed from the same material. However, the reinforcing fibers permit the process fluid to wick into the area with the magnets thereby permitting corrosion. Accordingly, it is desirable to use a non-reinforced plastic to encapsulate the magnets.

Inner drive assemblies have been proposed that have an impeller that is separable from the inner drive. In one example arrangement, a pentagonal extension from the impeller is received in a corresponding shaped aperture in the inner drive to permit the transfer of torque from the inner drive to the impeller. The coupling between the impeller and the inner drive typically causes cold flowing of the plastic, which undesirably distorts the plastic coating.

The separable impeller and inner drive have been secured by various locking features. In one example, multiple pins are used to retain the impeller and inner drive. In another arrangement, flexible prongs are received by the inner drive. A bushing directly supports the locking feature provided by the impeller, but does not directly support the inner drive. Instead, the inner drive is supported by the impeller requiring the tolerances between the inner drive and impeller interface to be tightly maintained to provide desired alignment between the bushing and inner drive.

What is needed is an improved two piece, separable impeller and inner drive that addresses the problems described above.

SUMMARY OF THE INVENTION

The present invention includes an inner drive assembly for a magnetic pump. The inner drive assembly includes an inner drive having magnets. The inner drive is rotatable about an axis and includes an inner drive inner surface. An impeller is secured to the inner drive by a locking feature that extends axially from the impeller. The impeller has an impeller inner surface provided by the locking feature. A bushing engages the inner surfaces and directly supports the inner drive and impeller.

The inner drive includes an outer surface and a drive pocket extending to the outer surface. A drive lug extends from the impeller and is received in the drive pocket for transmitting torque from the inner drive to the impeller. The arrangement of the drive pocket relative to the outer surface is less likely to trap the process fluid, which is desirable during service of the pump.

The inner drive includes a non-reinforced plastic for encapsulating the magnets. The impeller is constructed from a fiber reinforced plastic. A metal drive ring, which defines the drive pockets, is mounted on a metal yoke that supports the magnets. The drive ring is metallic and transfers torque to the impeller without deforming the non-reinforced plastic on the inner drive. The yoke is radially spaced from the locking feature to provide rigidity in the area of the locking feature to better maintain engagement between the inner drive and impeller.

Accordingly, the present invention provides an improved two piece, separable impeller and inner drive.

These and other features of the present invention can be best understood from the specification and drawings, the following of which is a brief description.

DETAILED DESCRIPTION OF THE PREFERRED EMBODIMENT

Figure 1:
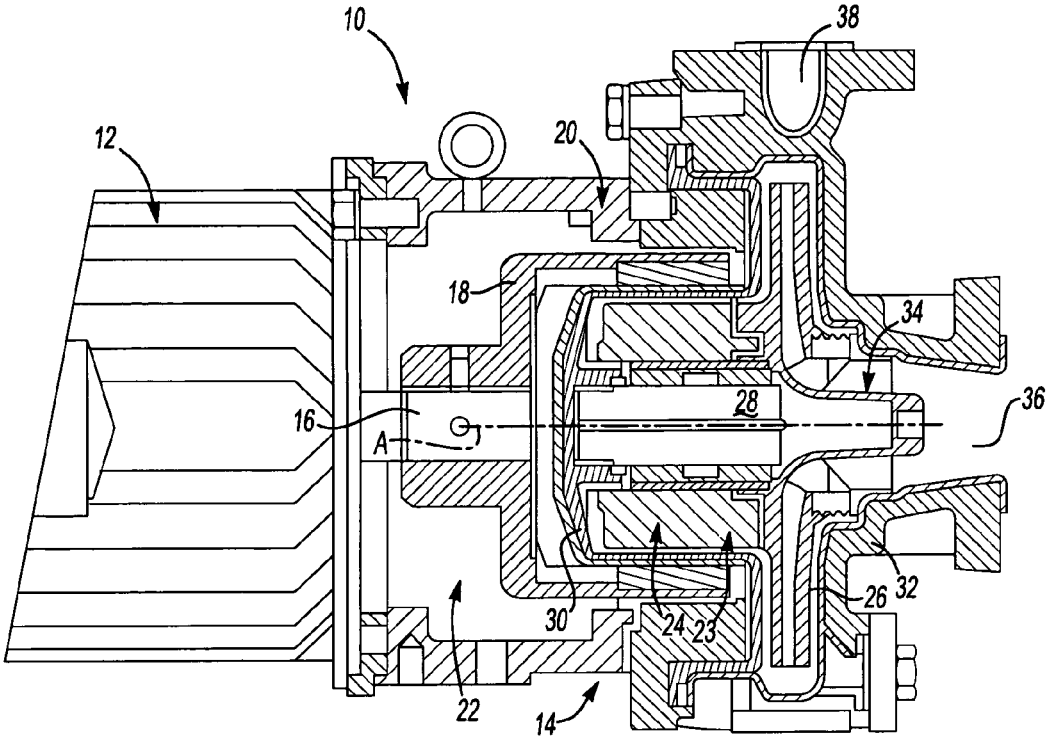
FIG. 1 is a cross-sectional view of a magnetically driven sealless centrifugal pump.

A magnetically driven sealless centrifugal pump assembly 10 is shown in FIG. 1. The assembly 10 includes a motor 12 driving a pump 14. Specifically, the motor 12 rotationally drives an outer drive 18 with a drive shaft 16. The outer drive 18 is supported within a housing 20 that defines a dry portion 22.

An inner drive assembly 23 includes an inner drive 24 and an impeller 26. The inner drive assembly 23 is mounted on a stationary shaft 28 and rotatable about an axis A. The inner drive assembly 23 is arranged within a containment shell 30 and a casing 32 that provide a wet portion 34. The wet portion 34 contains a process fluid that is pumped by the impeller 26 from an inlet 36 to an outlet 38. The inner drive 24 is rotationally driven in response to rotation of the outer drive 18, as is well known in the art.

Figure 2:
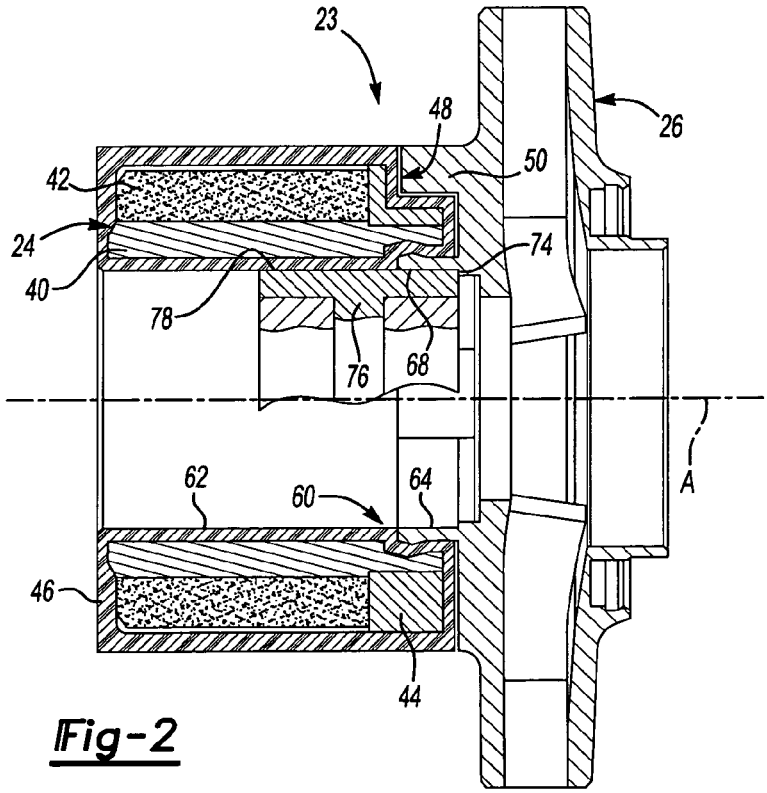
FIG. 2 is a cross-sectional view of the inventive inner drive assembly having a separable inner drive and impeller.

Referring to FIG. 2, the inner drive 24 includes a yoke 40 supporting multiple magnets 42 arranged circumferentially about the yoke 40. A spacer or drive ring 44 is mounted on the yoke 40 in an interference fit adjacent to the magnets 42. The yoke 40 is typically magnetic and the drive ring 44 is typically constructed from a non-magnetic metallic material.

The inner drive 24 is encapsulated in a non-reinforced plastic coating 46 to protect the magnet 42 and other inner drive components from the process fluid. Since the impeller 26 is separable from the inner drive 24, the impeller 26 may be constructed from a fiber reinforced plastic to provide structural rigidity to the impeller 26. The inner drive 24 and impeller 26 include faces 67 and 69 adjacent to one another. (See FIG. 3).

Figure 3A:
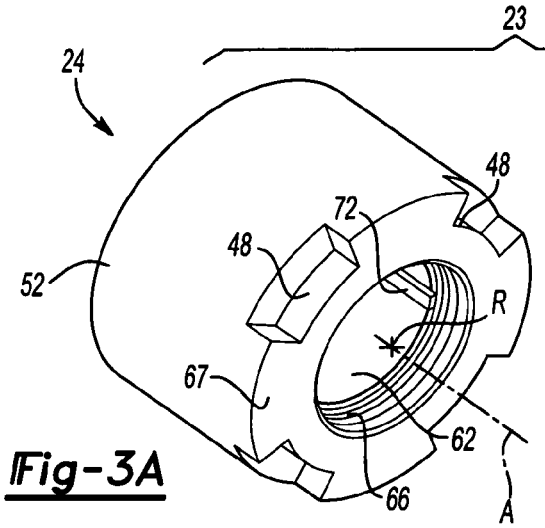
FIG. 3A is a perspective view of the inner drive.
Figure 3B:
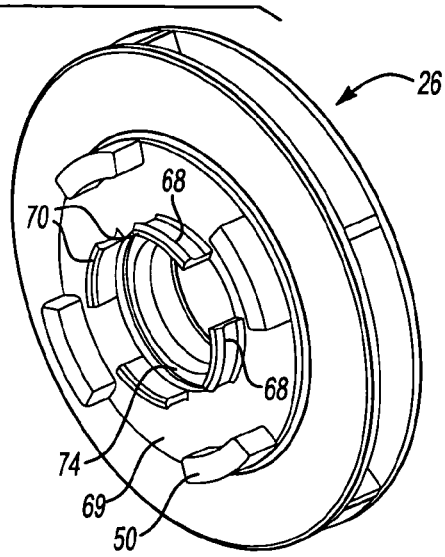
FIG. 3B is a perspective view of the impeller.
Figure 4:
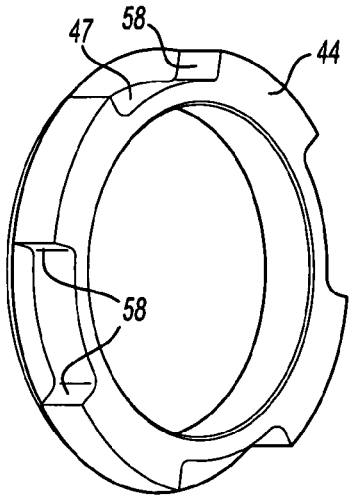
FIG. 4 is a perspective view of a drive ring used in the inventive inner drive assembly.

Referring to FIGS. 2 and 3A and B, the drive ring 44 includes circumferentially spaced drive ring pockets 48. The drive ring pockets 48 receive drive lugs 50 axially extending from the impeller 26. More specifically, the drive ring 44 provides cavities 47 that define the drive ring pockets 48, which is best shown in FIG. 4.

Preferably, the drive ring pockets 48 extend to an outer surface 52 of the inner drive 24, which prevents process fluid from becoming trapped within the drive ring pockets 48. Trapped process fluid, which is typically very corrosive, can pose a danger to technicians servicing the pump assembly 10.

Figure 5:
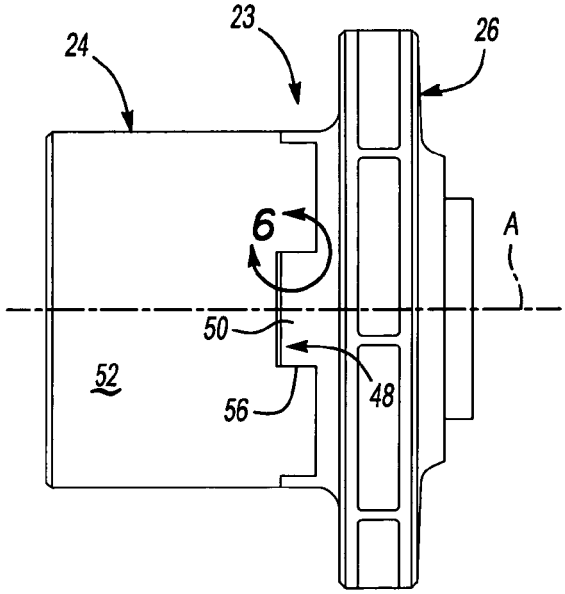
FIG. 5 is an elevational view of the inner drive assembly.
Figure 6:
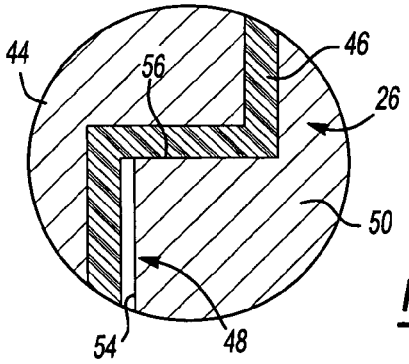
FIG. 6 is an enlarged cross-sectional view of the inner drive assembly indicated at circle 6 in FIG. 5.

Referring to FIGS. 5 and 6, an end 54 of the drive lugs 50 preferably extends adjacent to and in close proximity with the plastic coating 46 in the drive ring pockets 48, which prevents excess fluid from collecting within the drive ring pocket 48. The drive lugs 50 include spaced apart sides 56 that are in close proximity to lateral sides 58 provided by the drive ring 44. Preferably, the sides 56 and 58 are parallel to a radius R extending from the axis A to ensure efficient torque transmission from the inner drive 24 to the impeller 26 and minimize deformation of the coating 46.

The inner drive 24 includes an inner drive inner surface 62, and the impeller 26 includes an impeller inner surface 64. Complimentary locking feature 60 interlock the inner drive 24 and impeller 26. Specifically, multiple extensions 68 axially extending from the impeller 26 cooperate with an annular groove 66, or individual groove segments or pockets, spaced inwardly from the inner drive inner surface 62. A protuberance 70 on the extensions 68 extend radially outwardly and are received by the annular groove 66. The impeller inner surface 64 is provided by the extension 68. The inner surfaces 62 and 64 are generally cylindrical in shape and are aligned with one another so that a common line may extend along the inner surfaces 62 and 64. The inner drive includes a key 72 that rotationally locates a bushing 76. Alternatively, an interference fit can be used between the bushing 76 and inner drive 24. The bushing 76 supports both the inner drive 24 and impeller 26 by engaging the inner surfaces 62 and 64 with an outer surface 78 of the bushing 76. As a result, the inner drive 24 and impeller 26 need not be aligned relative to one another, which would require tight tolerance, but are instead aligned and supported directly by the bushing 76.

The bushing 76 is axially located against a shoulder 74 on the impeller 26. The bushing 76 maintains the extension 68 radially and maintains engagement with the annular groove 66.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An inner drive assembly for a magnetic pump comprising:

an inner drive having a magnet and rotatable about an axis, the inner drive including an inner drive inner surface;

an impeller removably secured to the inner drive by a flexible locking feature that extends axially from the impeller, the impeller having an impeller inner surface provided by the flexible locking feature; and a bushing in engagement with the inner surfaces, the bushing supporting the inner drive and the impeller.

2. The inner drive assembly according to claim 1, wherein the inner surfaces are arcuate.

3. The inner drive assembly according to claim 2, wherein the inner surfaces are aligned with one another to include a common axially extending line lying along the inner surfaces.

4. The inner drive assembly according to claim 3, wherein the inner surfaces provide a generally cylindrical surface mating with an outer surface of the bushing.

5. The inner drive assembly according to claim 1, wherein the bushing engages the flexible locking feature.

6. The inner drive assembly according to claim 1, wherein a groove is provided on one of the inner drive and the flexible locking feature, and a protuberance is provided on the other of the inner drive and flexible locking feature, the groove and protuberance interlocking with one another to retain the impeller relative to the inner drive.

7. An inner drive assembly for a magnetic pump comprising:

an inner drive having a magnet and rotatable about an axis, the inner drive including an inner drive inner surface, wherein the inner drive is encapsulated in an unbroken, non-reinforced plastic;

an impeller removably secured to the inner drive by a locking feature that extends axially from the impeller, the impeller having an impeller inner surface provided by the locking feature; and a bushing in engagement with the inner surfaces, the bushing supporting the inner drive and the impeller.

8. An inner drive assembly for a magnetic pump comprising:

an inner drive having a magnet and rotatable about an axis, the inner drive including an inner drive inner surface, wherein the inner drive includes a groove spaced radially outwardly from the inner drive inner surface;

an impeller removably secured to the inner drive by a locking feature that extends axially from the impeller, the impeller having an impeller inner surface provided by the locking feature, the locking feature provided by an extension having a protuberance that is received in and complementary to the groove; and a bushing in engagement with the inner surfaces, the bushing supporting the inner drive and the impeller.

9. An inner drive assembly for a magnetic pump comprising:

an inner drive rotatable about an axis, the inner drive having a outer surface and a drive pocket extending to the outer surface;

an impeller including an axially extending drive lug removably received in the drive pocket for transmitting torque from the inner drive to the impeller; and a locking feature provided by the impeller that is spaced from and radially inward relative to the drive lug the locking feature interconnecting the inner drive and impeller.

10. The inner drive assembly according to claim 9, wherein the drive pocket and drive lug include mating sides generally parallel with a radius extending through the axis.

11. The inner drive assembly according to claim 9, wherein the drive lug extends generally to the outer surface.

12. The inner drive assembly according to claim 9, wherein an axial end of the drive lug extends to a position adjacent to the inner drive.

13. An inner drive assembly for a magnetic pump comprising:

an inner drive rotatable about an axis, the inner drive having a outer surface and a drive pocket extending to the outer surface; and an impeller including an axially extending drive lug removably received in the drive pocket for transmitting torque from the inner drive to the impeller, wherein the inner drive includes a metallic drive ring defining the drive pocket, and a plastic coating arranged between the drive ring and drive lug.

14. The inner drive assembly according to claim 13, wherein the inner drive includes a yoke supporting magnets and the drive ring mounted on the yoke proximate to the magnets.

15. The inner drive assembly according to claim 14, wherein a locking feature extends axially from the impeller and is received by a complementary surface on the inner drive, yoke spaced radially from the locking feature, and a plastic coating covering the yoke providing the complementary surface.

16. An inner drive assembly for a magnetic pump comprising:

an inner drive including a magnet encapsulated by a non-reinforced plastic; and an impeller removably coupled to the inner drive by a locking feature, the impeller constructed of a fiber reinforced plastic.

17. The inner drive assembly according to claim 16, wherein the inner drive is rotatable about an axis and includes a yoke supporting the magnet, the yoke spaced radially from the locking feature with the non-reinforced plastic arranged between the yoke and locking feature.

18. The inner drive assembly according to claim 17, wherein the locking feature extends axially from the impeller.

19. The inner drive assembly according to claim 17, wherein a drive ring is mounted on the yoke, the drive ring defining a drive pocket receiving a drive lug that extends axially from the impeller, the non-reinforced plastic arranged between the drive ring and drive lug.

20. The inner drive assembly according to claim 19, wherein the drive ring and drive lug include mating sides generally parallel with a radius extending through the axis.

* * * * *

UNITED STATES PATENT AND TRADEMARK OFFICE

CERTIFICATE OF CORRECTION

PATENT NO. : 7,500,829 B2
APPLICATION NO. : 11/098336
DATED : March 10, 2009
INVENTOR(S) : Edwards et al.

It is certified that error appears in the above-identified patent and that said Letters Patent is hereby corrected as shown below:

Claim 9, Column 4, Line 52:

Add a comma between “lug” and “the” - “drive lug, the”

Signed and Sealed this

Second Day of June, 2009

JOHN DOLL
*Acting Director of the United States Patent and Trademark Office*